US012371289B2

(12) United States Patent
Jiang et al.

(10) Patent No.: US 12,371,289 B2
(45) Date of Patent: Jul. 29, 2025

(54) AUTOMATIC IMAGE POSITIONING SYSTEM FOR SHEET MATERIAL

(71) Applicant: Shanghai Eternal Machinery Co., Ltd., Shanghai (CN)

(72) Inventors: Hua Jiang, Shanghai (CN); Daniel Bernard Cugnoni, Shanghai (CN)

(73) Assignee: Shanghai Eternal Machinery Co., Ltd., Shanghai (CN)

( * ) Notice: Subject to any disclaimer, the term of this patent is extended or adjusted under 35 U.S.C. 154(b) by 244 days.

(21) Appl. No.: 17/606,979

(22) PCT Filed: Aug. 4, 2020

(86) PCT No.: PCT/CN2020/106774
§ 371 (c)(1),
(2) Date: Oct. 27, 2021

(87) PCT Pub. No.: WO2021/027624
PCT Pub. Date: Feb. 18, 2021

(65) Prior Publication Data

US 2022/0212889 A1 Jul. 7, 2022

(30) Foreign Application Priority Data

Aug. 13, 2019 (CN) ..... 201910746103.5

(51) Int. Cl.
*B65H 9/20* (2006.01)
*B65H 5/22* (2006.01)
*B65H 9/00* (2006.01)

(52) U.S. Cl.
CPC ..... *B65H 9/20* (2013.01); *B65H 5/224* (2013.01); *B65H 9/002* (2013.01); *B65H 2553/80* (2013.01)

(58) Field of Classification Search
CPC ..... B65H 9/002; B65H 9/20; B65H 5/224; B65H 11/005; B65H 29/242; B65H 2301/44735; B65H 2406/32
See application file for complete search history.

(56) References Cited

U.S. PATENT DOCUMENTS 3,774,905 A 11/1973 Williams
5,600,906 A * 2/1997 Hamid ..... B65H 29/242 198/689.1

(Continued)

FOREIGN PATENT DOCUMENTS

CN 205772158 U 12/2016
CN 108177995 A 6/2018

(Continued)

OTHER PUBLICATIONS

International Searching Authority/CN, International Search Report and Written Opinion of the International Searching Authority, Application No. PCT/CN2020/106774, dated Sep. 25, 2020, 10 pages (with English translation of the International Search Report).

*Primary Examiner* — Howard J Sanders
(74) *Attorney, Agent, or Firm* — Barclay Damon LLP

(57) ABSTRACT

The present invention relates to an automatic image positioning system for a sheet material. The automatic positioning system is used to convey the sheet material from a feeding place to a paper gripper bar. The automatic positioning system includes a first conveying device and a second conveying device, the automatic positioning system further includes a photoelectric detection device used to perform positioning and positioning correction on the sheet material, and the photoelectric detection device is provided at a starting end of the second conveying device (3). Compared with the prior art, the present invention utilizes an photoelectric detection device to perform positioning and positioning correction on a material, uses a vacuum adsorp- (Continued)

tion component to stabilize the material, and has advantages of high systemic positioning accuracy, high positioning correction accuracy, and strong material adaptability.

17 Claims, 4 Drawing Sheets

(56) References Cited

U.S. PATENT DOCUMENTS

| | | | | |
|---|---|---|---|---|
| 7,748,697 | B2 * | 7/2010 | Fujita | B65H 9/002 271/227 |
| 9,821,972 | B2 * | 11/2017 | Tseng | B41F 21/00 |
| 2010/0244364 | A1 * | 9/2010 | Komiyama | B65H 29/242 271/99 |

FOREIGN PATENT DOCUMENTS

| | | | | |
|---|---|---|---|---|
| CN | 210854491 | U | 6/2020 | |
| DE | 102016103127 | A1 * | 9/2016 | B26D 7/015 |
| JP | 2000034040 | A | 2/2000 | |

* cited by examiner

AUTOMATIC IMAGE POSITIONING SYSTEM FOR SHEET MATERIAL

CROSS-REFERENCE TO RELATED APPLICATIONS

This application is a national phase entry of Patent Cooperation Treaty Application PCT/CN2020/106774, filed Aug. 4, 2020, which in turn claims priority from Chinese Patent Application No. 201910746103.5 filed on Aug. 13, 2019. Each of the above-described applications is incorporated herein by reference in its entirety.

TECHNICAL FIELD

The present invention relates to an automatic positioning system, and in particular, to an automatic image positioning system for a sheet material.

BACKGROUND

A die-cutting machine is a paper packaging and post-printing mechanical device, and is mainly used for die-cutting (full-break, half-break) of a paperboard and a corrugated fiberboard, indentation and lettering operations, and automatic waste discharge. The die-cutting machine rolls and cuts printed products or paperboards into a certain shape by using stencils carved by knives, metal molds, steel wires, copper plates, lead plates or steel plates by applying a certain pressure by using embossed plates.

However, during the compression molding process, a material to be compressed has a certain position deviation on a feeding device, especially in die cutting of a paperboard, processes are carried out in sequence, and superposition of various factors reduces accuracy of die cutting, resulting in poor compression molding quality. Therefore, there is a need to set up a corresponding positioning system.

Most of the existing positioning systems use a physical stop block to position, and a certain degree of indentation on the material is easily caused. For the mounted paperboard or corrugated fiberboard, the printed paper is deformed after being mounted by glue, and a paperboard error becomes larger. As a result, an accuracy error occurring in die cutting after the physical front stop block is used to position also increases.

In most of the existing positioning systems, materials are conveyed in a fish scale manner. When a material to be compressed is being positioned and positioned for correction, a back part of the material is lifted by a next piece of material, so that the corrected material is not in a naturally flatten state, and the following materials are still moving. In this case, positioning correction accuracy of the materials is affected.

SUMMARY

An objective of the present invention is to provide an automatic image positioning system for a sheet material to overcome the above defects in the prior art.

The objective of the present invention can be achieved by the following technical solutions:

An automatic image positioning system for a sheet material is provided. The automatic positioning system is used to convey the sheet material from a feeding place to a paper gripper bar, the automatic positioning system includes a first conveying device and a second conveying device, the first conveying device, the second conveying device and the paper gripper bar have a same conveying speed when transferring the conveyed sheet material to each other, and the second conveying device has functions of longitudinal correction, lateral correction, and rotation angle correction; and the automatic positioning system further includes a photoelectric detection device used to perform positioning on the sheet material, and the photoelectric detection device is disposed at a starting end of the second conveying device.

Preferably, the photoelectric detection device includes a bracket and a photoelectric detection element used to perform positioning detection on the sheet material, the bracket is disposed at the starting end of the second conveying device, and the photoelectric detection element is fixed to the bracket.

Preferably, positioning marks provided on a front edge and side edges of the sheet material or on set positions are used as reference positions for positioning.

Preferably, positioning correction of the sheet material includes lateral correction, longitudinal correction and rotation angle correction, a lateral direction is along a conveying direction, a longitudinal direction is perpendicular to the conveying direction, so that the sheet material reaches a predetermined position accurately.

Preferably, after entering the second conveying device with a vacuum adsorption device, a front portion of the sheet material stops or makes the same constant-speed movement as a conveyor belt of the second conveying device, and the sheet material passes through a photoelectric detection area of the photoelectric detection device in this case, and after the sheet material is adsorbed on the conveyer belt of the second conveying device, the photoelectric detection device detects a specific position of the sheet material in this case.

Preferably, the system adopts a single-sheet conveying method per cycle process during conveying of sheet material.

Preferably, when a conveying frequency of the sheet material is less than a set value, the first conveying device and the second conveying device complete conveying in one working cycle, that is, it is one working cycle that is after the sheet material comes out of the feeding place and until the sheet material enters the paper gripper bar; and when a conveying frequency of the sheet material is greater than a set value, the first conveying device and the second conveying device separately complete conveying in one independent working cycle.

Preferably, the first conveying device includes a first drive component and at least two groups of first conveyor belt components;

each set of first conveyor belt components includes a first conveyor plate, a first conveyor belt, a first driven gear and four first auxiliary gears, the first conveyor belt is respectively connected to the first driven gear and the four first auxiliary gears, the first conveyor belt rotates under the drive of the first driven gear, and the first drive component includes a first servo motor and a first drive shaft, the first servo motor is connected to the first drive shaft, there is a drive-connection between the first drive shaft and the first driven gear, the servo motor drives the first drive shaft to rotate, and the first drive shaft drives the first driven gear to rotate.

Preferably, the second conveying device includes a vacuum adsorption component, a second drive component and four groups of second conveyor belt components;

each set of second conveyor belt components includes a second conveyor belt, a second driven gear and a second auxiliary gear, the second conveyor belt and the second driven gear are connected to the second auxiliary gear, the second drive component includes a second servo motor and a second drive shaft, the second servo motor is connected to the second drive shaft, the second drive shaft is connected to the second driven gear, the second servo motor drives the second drive shaft to rotate, and the second drive shaft drives the second driven gear to rotate; and the vacuum adsorption component is disposed below the second conveyor belt, the second conveyor belt is provided with a plurality of adsorption holes, and the vacuum adsorption component and the adsorption holes on the conveyor belt are connected.

Preferably, in the four groups of second conveyor belts, two groups of second conveyor belts located in the middle are suitable for any sheet material that meets a specification, and an adsorption function needs to be enabled once there is a material to be conveyed; and the adsorption function is enabled when two groups of second conveyor belts located on the outside have an action on the conveyed sheet material.

Compared with the prior art, the present invention has the following advantages:

The photoelectric detection device is used to perform positioning and positioning correction on the material. Compared with the conventional method in which the edge of the material is positioned by means of aligning and blocking, positioning can be completed more accurately and accuracy of the positioning system can be ensured in the present invention.

The second conveying device uses the vacuum adsorption component to ensure stability of the material on the conveyor belt, thus improve conveying reliability, and reduce an impact of the conveying process on positioning accuracy.

Currently, in the existing positioning system, conveying is performed in a fish scale manner, a back part of a corrected material is lifted by a next piece of material, so that the corrected material is not in a naturally flattened state, and the following materials are still moving. In this case, correction accuracy of the material is affected. However, in the present invention, a single-sheet material conveying method is used to improve positioning accuracy and positioning correction accuracy of the material.

1 A feeding place, 2 a first conveying device, 201 a first servo motor, 202 a first drive shaft, 203 a first conveyor belt, 204 a first driven gear, 205 a first auxiliary gear, 206 a first conveyor plate, 3 a second conveying device, 301 a second servo motor, 302 a second drive shaft, 303 a second driven gear, 304 a second auxiliary gear, 305 a second conveyor belt, 306 an adsorption hole, 4 a photoelectric detection device, 401 bracket, 402 photoelectric detection element. 5 a paper gripper bar, 6 a rotation angle correction servo motor, 7 a longitudinal correction servo motor, 8.1, 8.2, 8.3 positioning marks.

DETAILED DESCRIPTION OF EMBODIMENTS

The technical solutions in the embodiments of the present invention are described clearly and completely with reference to the drawings in the embodiments of the present invention. Obviously, the described embodiments are some embodiments of the present invention rather than all the embodiments. Based on the embodiments of the present invention, all other embodiments obtained by a person of ordinary skill in the art without creative efforts shall fall within the scope of protection of the present invention.

Embodiments

Figure 1:
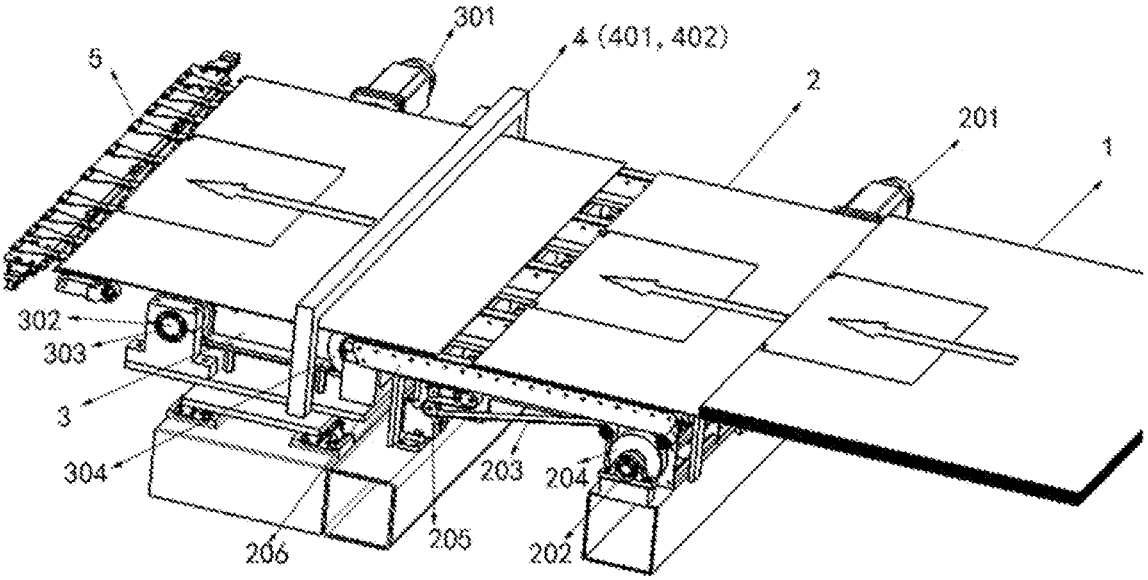
FIG. 1 is a schematic diagram of an automatic image positioning system for a sheet material according to the present invention.

An automatic image positioning system for a sheet material is provided. The automatic positioning system is used to convey the sheet material from a feeding place 1 to a paper gripper bar 5. As shown in FIG. 1, the automatic image positioning system for a sheet material includes a first conveying device 2, a second conveying device 3, and a photoelectric detection device 4. The first conveying device 2, the second conveying device 3 and the paper gripper bar 5 have a same conveying speed when transferring the conveyed sheet material to each other, the photoelectric detection device 4 is disposed at a starting end of the second conveying device 3, and the photoelectric detection device 4 is used to perform positioning and positioning correction on the sheet material. The photoelectric detection device 4 could specifically be a color mark sensor, an industrial camera, or a width and edge measurement sensor.

The present invention adopts a single-sheet conveying method in a conveying process, and marks (printing or engraving) on a front edge and side edges of a single-sheet material (such as a paperboard and a synthetic material plate with certain flexibility) or on determined positions are used as reference positions for positioning.

As shown in FIG. 1, the photoelectric detection device 4 includes a bracket 401 and a photoelectric detection element 402. The bracket 401 is disposed at the starting end of the second conveying device 3. The photoelectric detection element 402 is fixed to the bracket 401, and is used to perform positioning detection on the sheet material.

A positioning detection process is as follows: A piece of sheet material is adsorbed (grabbed) at the feeding place 1 on the right side in FIG. 1 and then drawn from a pile of papers and sent to the first conveyor belt 203. The first conveyor belt 203 moves the sheet material to the second conveyor belt 305 at a set speed. After entering the second conveyor belt 305 with a vacuum adsorption device, a front portion of the sheet material stops or does the same constant-speed movement as the second conveyor belt 305, and the sheet material passes through a region which the photoelectric detection device 4 detects in this case. After the sheet material is adsorbed on the second conveyor belt 305, the photoelectric detection device 4 detects a specific position of the sheet material in this case.

Figure 2:
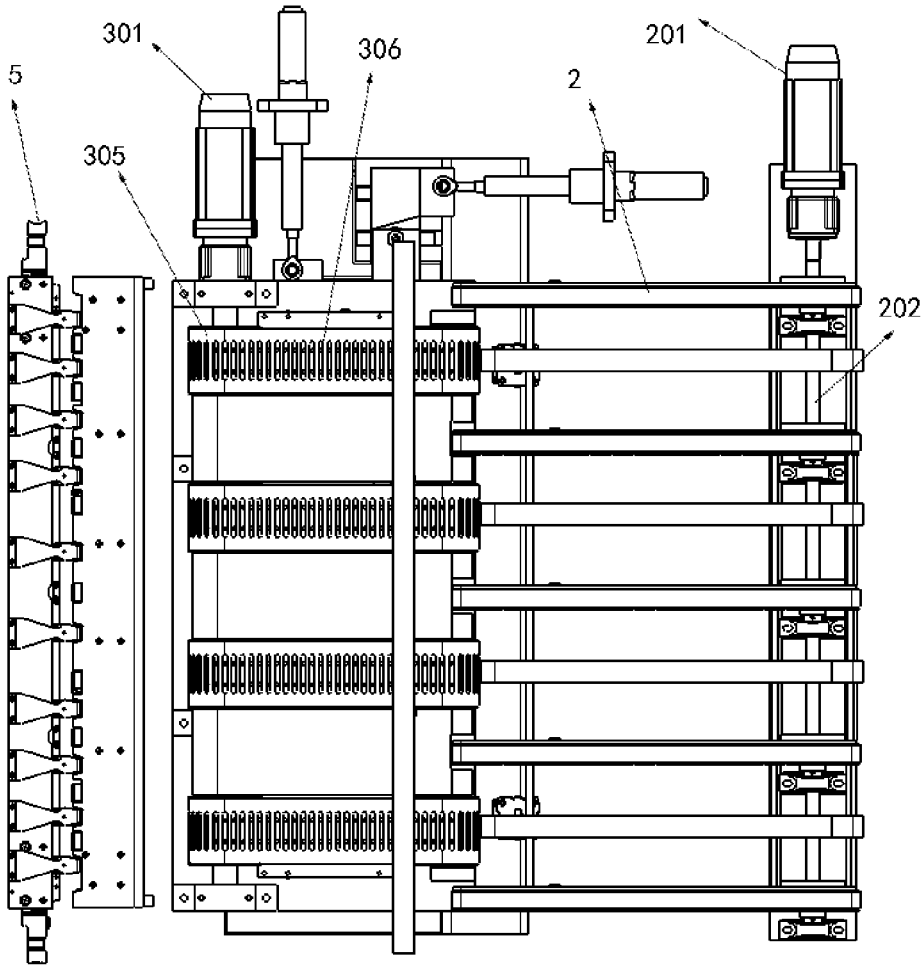
FIG. 2 is a plan view of an automatic image positioning system for a sheet material according to the present invention.
Figure 3:
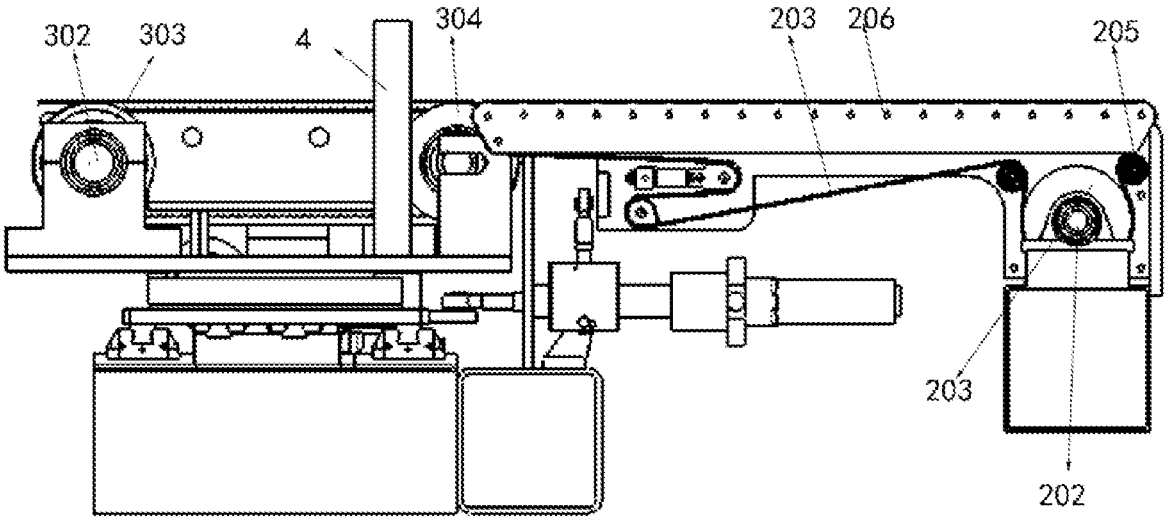
FIG. 3 is a side view of an automatic image positioning system for a sheet material according to the present invention.
Figure 4:
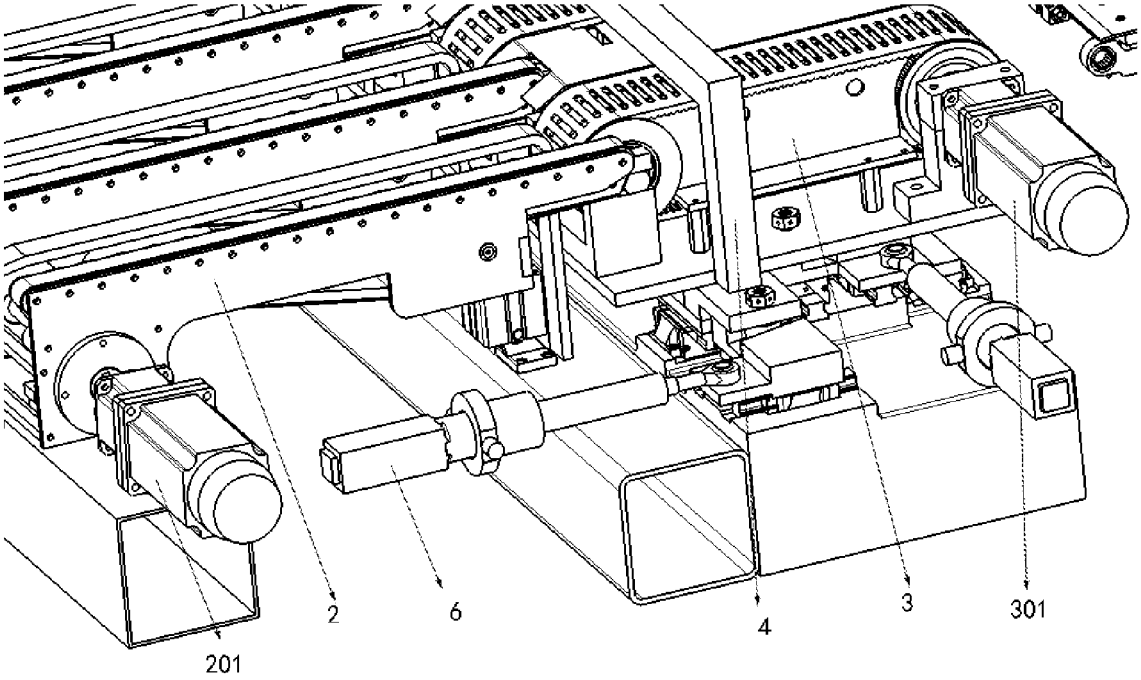
FIG. 4 is a partial schematic view of an automatic image positioning system for a sheet material according to the present invention.

As shown in FIG. 2-FIG. 4, the first conveying device 2 includes a first drive component and five groups of first conveyor belt components. Each group of first conveyor belt components includes a first conveyor plate 206, a first conveyor belt 203, a first driven gear 204, and four first auxiliary gears 205. The first conveyor belt 203 is connected to the first driven gear 204 and the four first auxiliary gears 205. The first conveyor belt 203 rotates under the drive of the first driven gear 204. The first conveyor belt 203 covers the upper surface of the first conveyor plate 206. The first drive component includes a first servo motor 201 and a first drive shaft 202. The first servo motor 201 drives the first drive shaft 202 to rotate. There is a drive connection between the first drive shaft 202 and the first driven gear 204. In addition, the first drive shaft 202 drives the driven gear to rotate.

As shown in FIG. 2-FIG. 4, the second conveying device 3 includes a vacuum adsorption component, a second drive component, and four groups of second conveyor belt components. Each group of second conveyor belt components includes a second conveyor belt 305 and a second driven gear 303 and a second auxiliary gear 304. The second conveyor belt 305 is connected to the second driven gear 303 and the second auxiliary gear 304. The second drive component includes a second servo motor 301 and a second drive shaft 302. The second servo motor 301 drives the second drive shaft 302 to rotate, the second drive shaft 302 is connected to the second driven gear 303, and the second drive shaft 302 drives the second driven gear 303 to rotate. The vacuum adsorption component is located below the second conveyor belt 305, the second conveyor belt 305 is provided with a plurality of adsorption holes 306, and the vacuum adsorption component communicates with the adsorption holes 306 on the conveyor belt. Two groups of second conveyor belt components located in the middle are suitable for any sheet material that meets a specification, and an adsorption function needs to be enabled once there is a material to be conveyed. An adsorption function is enabled when two groups of second conveyor belt components located on the outside has an action on the conveyed sheet material.

Figure 5:
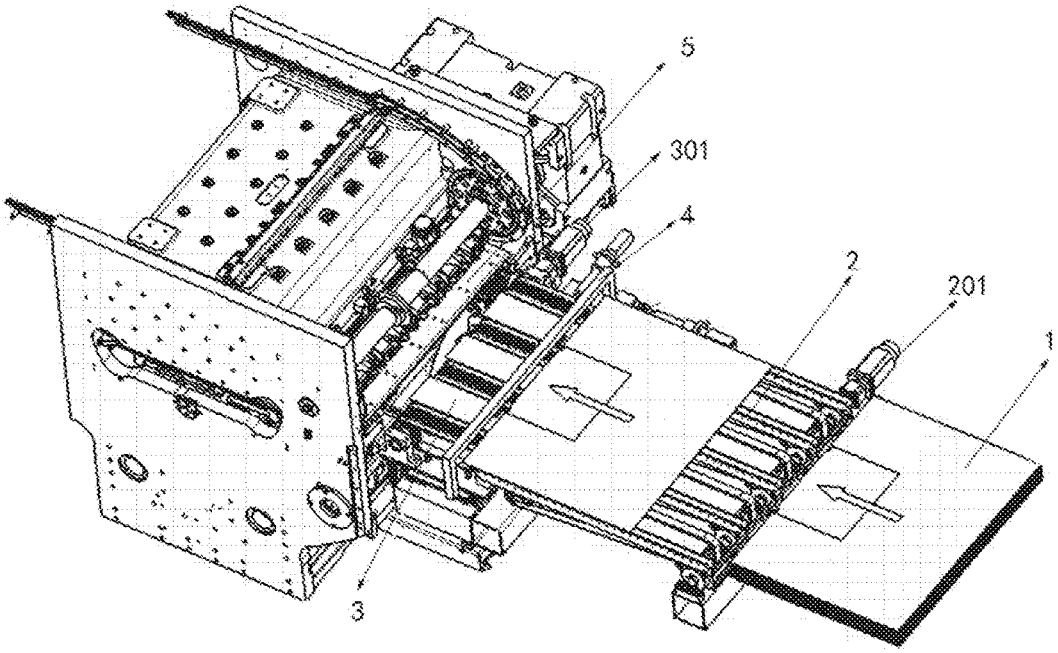
FIG. 5 is a schematic diagram of an automatic image positioning system for a sheet material in actual use according to the present invention.
Figure 6:
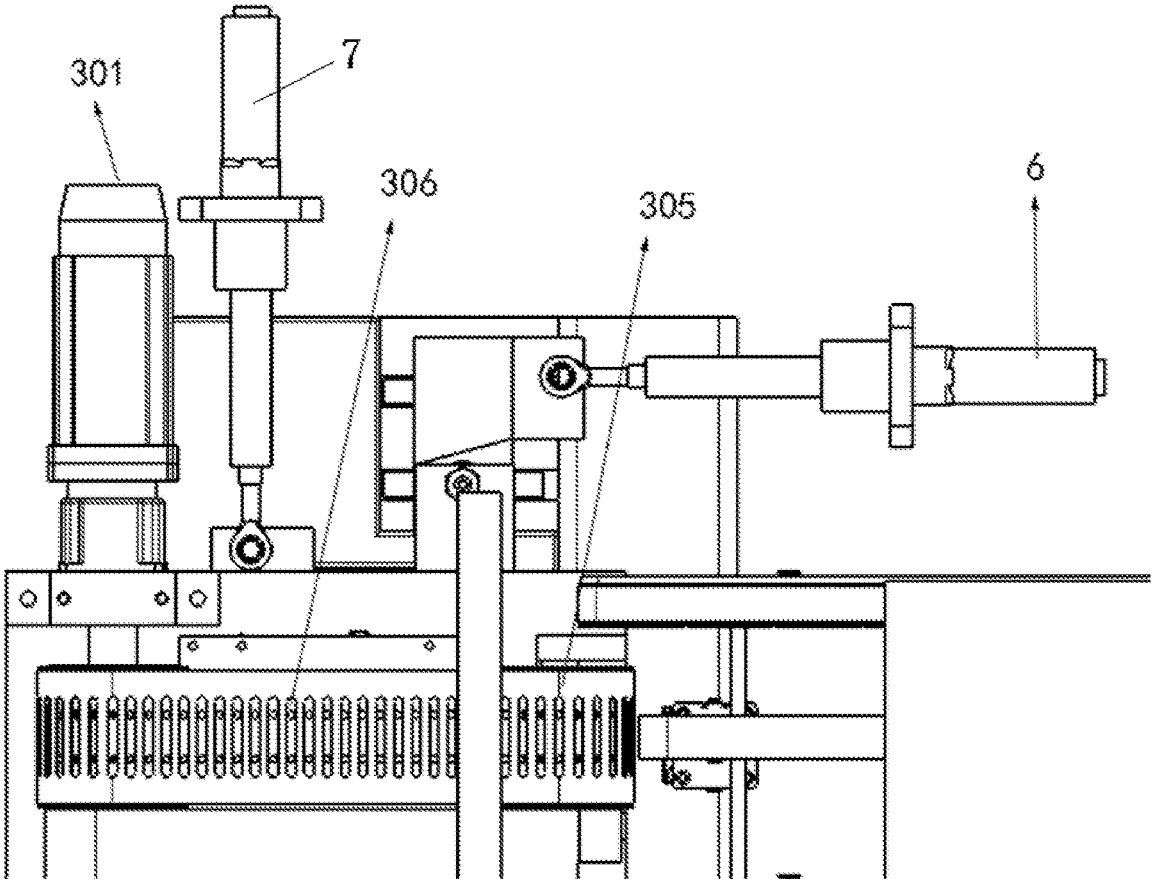
FIG. 6 is a partial structural diagram of a second conveying device in an automatic image positioning system for a sheet material according to the present invention.

As shown in FIG. 5, when the system is used, a piece of sheet material is sent to the first conveying device 2, a front portion of the sheet material is provided with a printing mark, and the first conveying device 2 conveys the sheet material to the second conveying device 3. When the sheet material is conveyed to the second conveying device 3, the conveyed material stops or runs at the same speed as the second conveyor belt 305, and the conveyed material is adsorbed on the second conveyor belt 305 by the vacuum adsorption component. In this case, the photoelectric detection device 4 locates the sheet material and transmits positioning data to a control device. The control device compares the positioning data with preset theoretical data, and calculates a distance and a rotation angle that the second conveying device needs to operate, that is, a distance and a rotation angle that need to be corrected for the material, and then the second conveying device 3 is notified of running and then transferring the material to the paper gripper bar 5 according to the corrected data.

The second conveying device 3 performs positioning correction on the sheet material during the conveying process. The correction process includes lateral (along a conveying direction) correction, longitudinal (perpendicular to the conveying direction) correction and rotation angle correction, so that the sheet material reaches a predetermined position accurately.

When the paper gripper bar 5 grabs the sheet material and starts to move, the vacuum adsorption device of the second conveying device 3 is closed and an air pressure is injected to release the adsorbed sheet material, and conveying of the sheet material is completed.

A specific process of lateral (along a conveying direction) correction, longitudinal (perpendicular to the conveying direction) correction and rotation angle correction is as follows:

The lateral correction is implemented by changing a conveying speed of the second conveying device 3 by the second servo motor 301, the longitudinal (perpendicular to the conveying direction) correction is implemented by driving the second conveying device 3 by a longitudinal correction servo motor 7, and the rotation angle correction is implemented by driving the second conveying device 3 to rotate by a rotation angle correction servo motor 6.

Figure 7:
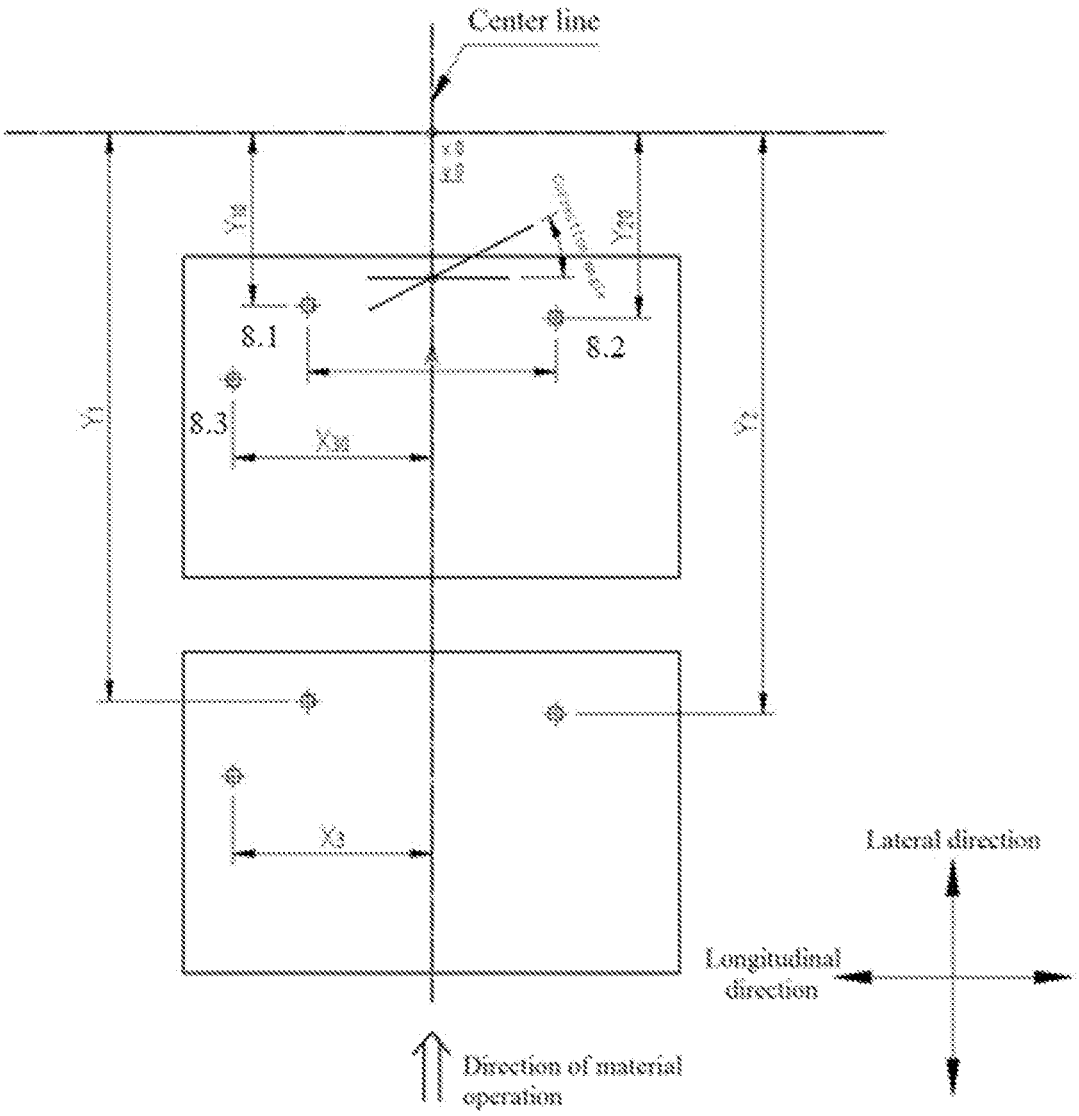
FIG. 7 is a schematic diagram of calculation of each correction amount of an automatic image positioning system used for a sheet material according to the present invention.

Each correction amount is shown in FIG. 7, and $X_3$-$X_{30}$ is a longitudinal correction displacement amount;

$$(Y_1 - Y_{10}) \pm \frac{A}{2} \cdot \tan\left(\arctan\frac{Y_2 - Y_{20}}{A}\right)$$

is a lateral correction displacement; and $$\arctan\frac{Y_2 - Y_{20}}{A}$$

is a correction angle.

The present invention is particularly suitable for the mounted paperboard (or corrugated fiberboard), and because the printed paper is deformed after being mounted by glue, a paperboard error becomes larger (reaching or exceeding 0.5 mm). As a result, an accuracy error occurring in die cutting after the physical front stop block is used to position also increases accordingly.

The first conveying device 2 and the second conveying device 3 of the present invention can adopt two embodiments:

The first conveying device 2 and the second conveying device 3 complete conveying in one working cycle, that is, it is one working cycle that is after the sheet material comes out from the bottom feeding place 1, and until the material enters the paper gripper bar system. When a conveying frequency of the material is low (generally, less than 2000 pieces per hour), this method can be used.

When a conveying frequency of the material is high (generally, more than 2,000 to 3,000 pieces per hour), the above time left for photoelectric detection device 4 to read becomes shorter, reading failure easily occurs, and the system is unable to operate normally. In this case, the first conveying device 2 and the second conveying device 3 can separately complete conveying in one independent working cycle. In this way, there is more time for photoelectric detection device 4 to read, and the conveying frequency that this system adapts is higher.

The foregoing embodiments are merely intended for describing the technical solutions of the present invention, but not for limiting the present invention. Any person skilled in the art can easily think of various equivalent modifications or replacements within the technical scope disclosed by the present invention, these modifications or replacements should be covered within the scope of protection of the present invention. Therefore, the scope of protection of the present invention shall be subject to the scope of protection of the claims.

What is claimed is:

1. An automatic image positioning system for a sheet material, wherein the automatic positioning system is used to convey the sheet material sequentially from a feeding place (1) to a paper gripper bar (5), via a first conveying device (2) and then a second conveying device (3), wherein the first conveying device (2), the second conveying device (3) and the paper gripper bar (5) have a same conveying speed when transferring the conveyed sheet material to each other, the second conveying device (3) configured to perform functions of longitudinal correction, lateral correction, and rotation angle correction while conveying the sheet material; and the automatic positioning system further comprises a photoelectric detection device (4) used to perform positioning on the sheet material, and the photoelectric detection device (4) is disposed at a starting end of the second conveying device (3), wherein the first conveying device (2) comprises a first drive component and at least two groups of first conveyor belt components, and wherein each group of first conveyor belt components comprises a first conveyor plate (206), a first conveyor belt (203), a first driven gear (204) and four first auxiliary gears (205), the first conveyor belt (203) is respectively connected to the first driven gear (204) and the four first auxiliary gears (205), the first conveyor belt (203) rotates under the drive of the first driven gear (204), the first drive component includes a first servo motor (201) and a first drive shaft (202), the first servo motor (201) is connected to the first drive shaft (202), there is a drive-connection between the first drive shaft (202) and the first driven gear (204), the servo motor (201) drives the first drive shaft (202) to rotate, and the first drive shaft (202) drives the first driven gear (204) to rotate.

2. The automatic image positioning system for a sheet material according to claim 1, wherein the photoelectric detection device (4) comprises a bracket (401) and a photoelectric detection element (402) used to perform positioning detection on the sheet material, the bracket (401) is disposed at the starting end of the second conveying device (3), and the photoelectric detection element (402) is fixed to the bracket (401).

3. The automatic image positioning system for a sheet material according to claim 1, wherein positioning marks (8.1, 8.2, 8.3) provided on a front edge and side edges of the sheet materials or on set positions are used as reference positions for positioning.

4. The automatic image positioning system for a sheet material according to claim 1, wherein positioning correction performed on the sheet material comprises lateral correction, longitudinal correction and rotation angle correction, a lateral direction is along a conveying direction, a longitudinal direction is perpendicular to the conveying direction, so that the sheet material reaches a predetermined position accurately.

5. The automatic image positioning system for a sheet material according to claim 1, wherein after entering the second conveying device (3) with a vacuum adsorption device, a front portion of the sheet material stops or makes the same constant-speed movement as a conveyor belt of the second conveying device (3), and the sheet material passes through a photoelectric detection area of the photoelectric detection device (4), wherein the photoelectric detection device (4) detects a specific position of the sheet material.

6. The automatic image positioning system for a sheet material according to claim 1, wherein the system adopts a single-sheet conveying method per cycle process during conveying of the sheet material.

7. The automatic image positioning system for a sheet material according to claim 1, wherein when a conveying frequency of the sheet material is less than a set value, the first conveying device (2) and the second conveying device (3) complete conveying in one working cycle, that is, it is one working cycle that is after the sheet material comes out of the feeding place (1) and until the sheet material enters the paper gripper bar (5); and when a conveying frequency of the sheet material is greater than a set value, the first conveying device (2) and the second conveying device (3) separately complete conveying in one independent working cycle.

8. The automatic image positioning system for a sheet material according to claim 1, wherein the second conveying device (3) includes a vacuum adsorption component, a second drive component and four groups of second conveyor belt components;

each group of second conveyor belt components comprises a second conveyor belt (305), a second driven gear (303) and a second auxiliary gear (304), the second conveyor belt (305) is connected to the second driven gear (303) and the second auxiliary gear (304), the second drive component comprises a second servo motor (301) and a second drive shaft (302), the second servo motor (301) is connected to the second drive shaft (302), the second drive shaft (302) is connected to the second driven gear (303), the second servo motor (301) drives the second drive shaft (302) to rotate, and the second drive shaft (302) drives the second driven gear (303) to rotate; and the vacuum adsorption component is disposed below the second conveyor belt (305), the second conveyor belt (305) is provided with a plurality of adsorption holes (306), and the vacuum adsorption component and the adsorption holes (306) on the conveyor belt are connected.

9. The automatic image positioning system for a sheet material according to claim 8, wherein in the four groups of second conveyor belt components two groups of second conveyor belt components located in the middle are suitable for any sheet material that meets a specification, an adsorption function needs to be enabled once there is a material to be conveyed; and an adsorption function is enabled when two groups of second conveyor belts components located on the outside have an action on the conveyed sheet material.

10. An automatic image positioning system for a sheet material, wherein the automatic positioning system is used to convey the sheet material sequentially from a feeding place (1) to a paper gripper bar (5), via a first conveying device (2) and then a second conveying device (3), wherein the first conveying device (2), the second conveying device (3) and the paper gripper bar (5) have a same conveying speed when transferring the conveyed sheet material to each other, the second conveying device (3) configured to perform functions of longitudinal correction, lateral correction, and rotation angle correction while conveying the sheet material;

and the automatic positioning system further comprises a photoelectric detection device (4) used to perform positioning on the sheet material, and the photoelectric detection device (4) is disposed at a starting end of the second conveying device (3), wherein the second conveying device (3) includes a vacuum adsorption component, a second drive component and four groups of second conveyor belt components;

and wherein each group of second conveyor belt components comprises a second conveyor belt (305), a second driven gear (303) and a second auxiliary gear (304), the second conveyor belt (305) is connected to the second driven gear (303) and the second auxiliary gear (304), the second drive component comprises a second servo motor (301) and a second drive shaft (302), the second servo motor (301) is connected to the second drive shaft (302), the second drive shaft (302) is connected to the second driven gear (303), the second servo motor (301) drives the second drive shaft (302) to rotate, and the second drive shaft (302) drives the second driven gear (303) to rotate; and the vacuum adsorption component is disposed below the second conveyor belt (305), the second conveyor belt (305) is provided with a plurality of adsorption holes (306), and the vacuum adsorption component and the adsorption holes (306) on the conveyor belt are connected.

11. The automatic image positioning system for a sheet material according to claim 10, wherein in the four groups of second conveyor belt components two groups of second conveyor belt components located in the middle are suitable for any sheet material that meets a specification, an adsorption function needs to be enabled once there is a material to be conveyed; and an adsorption function is enabled when two groups of second conveyor belts components located on the outside have an action on the conveyed sheet material.

12. The automatic image positioning system for a sheet material according to claim 10, wherein the photoelectric detection device (4) comprises a bracket (401) and a photoelectric detection element (402) used to perform positioning detection on the sheet material, the bracket (401) is disposed at the starting end of the second conveying device (3), and the photoelectric detection element (402) is fixed to the bracket (401).

13. The automatic image positioning system for a sheet material according to claim 10, wherein positioning marks (8.1, 8.2, 8.3) provided on a front edge and side edges of the sheet materials or on set positions are used as reference positions for positioning.

14. The automatic image positioning system for a sheet material according to claim 10, wherein positioning correction performed on the sheet material comprises lateral correction, longitudinal correction and rotation angle correction, a lateral direction is along a conveying direction, a longitudinal direction is perpendicular to the conveying direction, so that the sheet material reaches a predetermined position accurately.

15. The automatic image positioning system for a sheet material according to claim 10, wherein after entering the second conveying device (3) with a vacuum adsorption device, a front portion of the sheet material stops or makes the same constant-speed movement as a conveyor belt of the second conveying device (3), and the sheet material passes through a photoelectric detection area of the photoelectric detection device (4), wherein the photoelectric detection device (4) detects a specific position of the sheet material.

16. The automatic image positioning system for a sheet material according to claim 10, wherein the system adopts a single-sheet conveying method per cycle process during conveying of the sheet material.

17. The automatic image positioning system for a sheet material according to claim 10, wherein when a conveying frequency of the sheet material is less than a set value, the first conveying device (2) and the second conveying device (3) complete conveying in one working cycle, that is, it is one working cycle that is after the sheet material comes out of the feeding place (1) and until the sheet material enters the paper gripper bar (5); and when a conveying frequency of the sheet material is greater than a set value, the first conveying device (2) and the second conveying device (3) separately complete conveying in one independent working cycle.

* * * * *